US008590638B2

(12) United States Patent
Downton

(10) Patent No.: US 8,590,638 B2
(45) Date of Patent: Nov. 26, 2013

(54) INTELLIGENT WELLBORE PROPAGATION SYSTEM

(75) Inventor: Geoffrey C. Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 451 days.

(21) Appl. No.: 12/887,188

(22) Filed: Sep. 21, 2010

(65) Prior Publication Data

US 2012/0067648 A1 Mar. 22, 2012

(51) Int. Cl.
*E21B 7/10* (2006.01)

(52) U.S. Cl.
USPC ..... 175/74; 175/75; 175/61; 166/255.3; 29/428

(58) Field of Classification Search
USPC ..... 175/73–75, 61; 29/428; 166/250.01, 166/117.5, 255.3, 50
See application file for complete search history.

(56) References Cited

U.S. PATENT DOCUMENTS

2006/0249287 A1* 11/2006 Downton et al. ..... 166/250.1
2008/0245568 A1* 10/2008 Jeffryes ..... 175/16

* cited by examiner

*Primary Examiner* — Yong-Suk (Philip) Ro
(74) *Attorney, Agent, or Firm* — Chadwick A. Sullivan; Brigitte Jeffert Echols

(57) ABSTRACT

A technique utilizes a monolithic wellbore propagation system to facilitate the drilling of deviated wellbores. A steerable drilling assembly is formed with a monolithic structure having both a bit body section and a steering body section. The steering body section comprises a cavity sized to receive a control system within the monolithic structure. Addition of the control system enables operational control over the steerable drilling assembly to facilitate formation of a desired, deviated wellbore section.

15 Claims, 2 Drawing Sheets

INTELLIGENT WELLBORE PROPAGATION SYSTEM

BACKGROUND

Oil and gas reservoirs may be accessed by drilling wellbores to enable production of hydrocarbon fluid, e.g. oil and/or gas, to a surface location. In many environments, directional drilling techniques have been employed to gain better access to the desired reservoirs by forming deviated wellbores as opposed to traditional vertical wellbores. However, forming deviated wellbore sections can be difficult and requires directional control over the orientation of the drill bit used to drill the deviated wellbore.

Rotary steerable drilling systems have been used to drill deviated wellbore sections while enabling control over the drilling directions. Such drilling systems often are classified as push-the-bit systems or point-the-bit systems and allow an operator to change the orientation of the drill bit and thus the direction of the wellbore. In conventional rotary steerable drilling systems, the drill bit section or housing is connected to a steering control section or housing by a field separable connection, such as a standard API (American Petroleum Institute) connection. However, accommodation of the API connection requires a longer overall rotary steerable system, resulting in design constraints with respect to both the drill bit section and the overall steerable system. The extra length is required regardless of whether the API connection is a common pin-up connection or a less common pin-down connection.

SUMMARY

In general, a system and methodology is provided to facilitate the drilling of deviated wellbores. A steerable drilling assembly is formed with a monolithic structure having both a bit body section and a steering body section. The steering body section comprises a cavity sized to receive a control system within the monolithic structure. As a result, a control system may be located in the cavity and employed in exercising operational control over the steerable drilling assembly to facilitate formation of a desired, deviated wellbore section.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
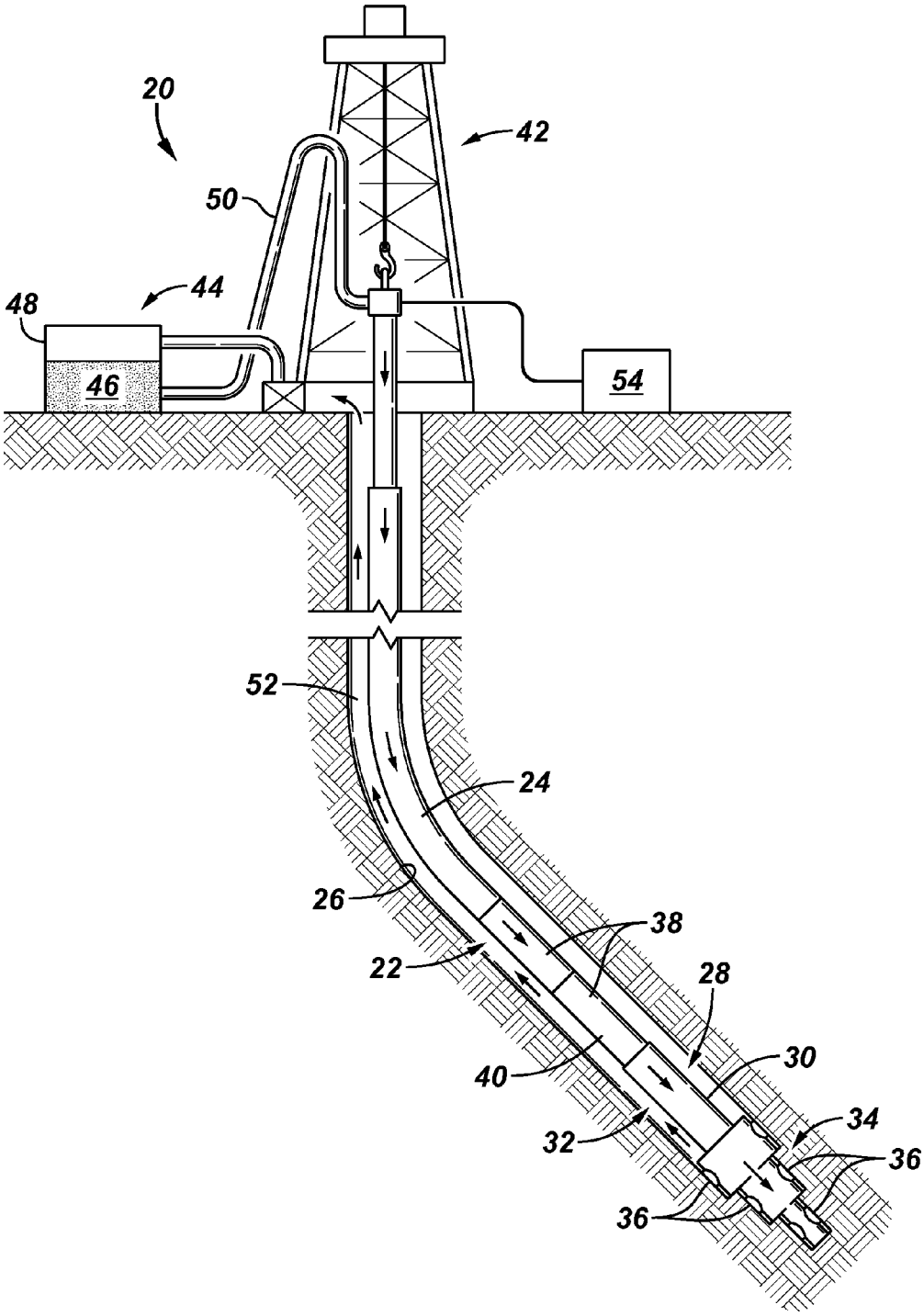
FIG. 1 is a schematic illustration of an example of a drill string which includes a steerable drilling assembly formed with a monolithic structure, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The embodiments described herein generally relate to a system and method for facilitating the drilling of a deviated wellbore. A steerable drilling assembly is constructed with a combined bit body section and steering body section formed as a monolithic structure. The steering body section is designed to enclose the control system of the steerable drilling assembly to enable directional drilling of a wellbore along a desired heading or azimuth.

The monolithic structure is a unitary structure which cannot be separated into separate components in the field as with conventional systems. By combining both the bit body section and the steering body section into the single monolithic structure, the need for a connector, e.g. a standard API connector, between the drilling section and the steering/control section is avoided. As a result, the distance between drill bit and steering actuators can be reduced to enhance the capability of the drilling assembly to drill a desired dogleg or other desired trajectory during formation of the wellbore. Use of the monolithic structure also allows for a wider range of drill bit designs and allows construction of a variety of drilling components and cutter arrangements different from traditional drill bits, as discussed in greater detail below.

Depending on both the environment in which the wellbores are formed and on the desired characteristics of the steerable drilling assembly, the monolithic structure may be constructed according to a variety of methods. For example, the monolithic structure may be a single metal structure which includes both the bit body section and the steering body section. The single metal structure may be formed by machining a single billet of steel or other suitable metal or material. In other embodiments, the single structure may be formed by casting, molding, forging, metal powder techniques, composite and matrix infiltration, and other formation techniques which create the single structure.

However, the monolithic structure also maybe formed by combining two or more components in a manner which creates a monolithic structure, i.e. a structure that is not field breakable. By way of example, the monolithic structure may be constructed by welding assemblies together, by press fitting assemblies together, or by swaging assemblies together. The only field breakable connection, e.g. API connection, is at the top end of the monolithic structure to enable connection of the monolithic structure to the drill string.

According to one embodiment, the steerable drilling assembly is designed so the monolithic structure contains the total steering system. For example, the steering body section of the monolithic structure may be designed to contain a steering control system. In some embodiments, the steering control system is a modular control unit which is selectively removable. The steering control system may be designed to interact with sensors and/or steering actuators to control the directional drilling of the steerable drilling assembly. Depending on desired system capabilities, the steering control system may be employed to sense the tool face direction and thus the direction the wellbore is being propagated. Additionally, the steering control system may be used to apply desired steering forces to the drill bit, and to control power to the steering actuators. The steering control system also may be constructed as a closed loop control for closing the control loop between directional measurements received from sensors and steering actuation output via the steering actuators. All of this functionality may be provided by a control system contained within the monolithic structure.

As described in greater detail below, the steerable drilling assembly and its monolithic structure may be combined with a variety of cutters, sensors, and steering actuators in various patterns along the monolithic structure. In some embodiments, various cutting elements may be combined with the monolithic structure late in the manufacturing/assembly process, and the types of cutters and sensors can be easily changed. Steering assembly features, including cutters, sensors, steering actuators, and/or the modular control system, also may be changed between drilling jobs in some embodiments.

Referring generally to FIG. 1, one embodiment of a drilling system 20 is illustrated as having a bottom hole assembly 22 which is part of a drill string 24 used to form a desired, directionally drilled wellbore 26. The illustrated drilling system 20 comprises a steerable drilling assembly 28, e.g. a rotary steerable drilling assembly, formed with a monolithic structure or body 30. The monolithic structure 30 has a steering body section 32 and a bit body section 34 formed together as the single monolithic structure 30. Steering actuators 36 may be mounted to monolithic structure 30, e.g. to the bit body section 34, to provide the desired lateral forces for steering the steerable drilling assembly 28 and forming the desired deviated wellbore 26.

Depending on the environment and the operational parameters of the drilling job, drilling system 20 may comprise a variety of other features. For example, drill string 24 may include drill collars 38 which, in turn, may be designed to incorporate desired drilling modules, such as logging-while-drilling and/or measurement-while-drilling modules 40. In some applications, stabilizers may be used along the drill string to stabilize the drill string with respect to the surrounding wellbore wall.

Various surface systems also may form a part of the drilling system 20. In the example illustrated, a drilling rig 42 is positioned above the wellbore 26 and a drilling mud system 44 is used in cooperation with the drilling rig. For example, the drilling mud system 44 may be positioned to deliver drilling fluid 46 from a drilling fluid tank 48. The drilling fluid 46 is pumped through appropriate tubing 50 and delivered down through drilling rig 42 and into drill string 24. In many applications, the return flow of drilling fluid flows back up to the surface through an annulus 52 between the drill string 24 and the surrounding wellbore wall (see arrows showing flow down through drill string 24 and up through annulus 52). The drilling system 20 also may comprise a surface control system 54 which may be used to communicate with steerable drilling assembly 28. In some embodiments, the surface control system 54 communicates with a downhole steering control system within steerable drilling assembly 28.

Figure 2:
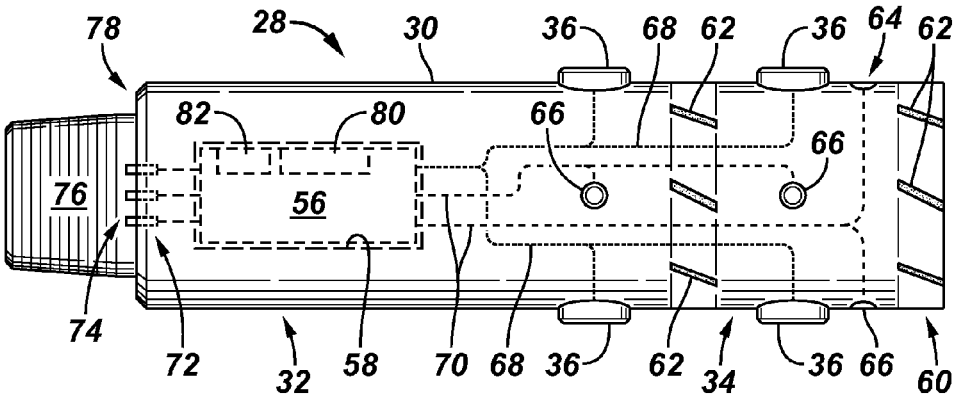
FIG. 2 is a schematic illustration of an example of a steerable drilling assembly having a bit body section and a steering body section formed as a monolithic structure, according to an embodiment of the present invention.

Referring generally to FIG. 2, a schematic embodiment of steerable drilling assembly 28 is illustrated. In this embodiment, a plurality of the steering actuators 36 is distributed along the monolithic structure 30, and a steering control system 56 is disposed within the monolithic structure 30. For example, steering actuators 36 may be distributed over the bit body section 34, and the steering control system 56 may be deployed in a cavity 58 within steering body section 32 of the monolithic structure 30.

In the example illustrated, steerable drilling assembly 28 also comprises a cutter structure 60 having plurality of cutters 62 mounted on or within the monolithic structure 30. The steerable drilling assembly 28 also comprises a sensor system 64 having one or more sensors 66 mounted on the monolithic structure 30. The cutters 62 may be interspersed with the steering actuators 36, i.e. the cutters 62 may be mounted on or within monolithic structure 30 such that the cutters are above, below, and/or in-line with the steering actuators 36. In the embodiment illustrated, for example, steering actuators 36 are disposed along a length of the monolithic body 30 and the cutters 62 are placed between the steering actuators 36. As discussed in greater detail below, cutters 62 also may be placed on the steering actuators 36. Similarly, sensors 66 may be distributed along monolithic structure 30 and, in some embodiments, interspersed with the steering actuators 36 and the cutters 62.

Cutters 62 may be formed in a variety of shapes and configurations depending on the parameters of a given drilling operation and the environment in which the wellbore 26 is formed. The cutters also may be formed from a variety of materials, such as hardened steels, polycrystalline diamond compact (PDC), and other hardened materials, designed for cutting operations. The cutters 62 are mounted within or on monolithic structure 30 by a variety of mounting mechanisms, including weldments or fasteners, e.g. bolts, which enable interchanging of cutters or replacement of cutters.

Depending on the drilling operation and environment, sensors 66 also may have a variety of forms, configurations, and arrangements on monolithic structure 30. For example, sensors 66 may comprise information measurement sensors positioned between and/or in line with the cutters 62 and actuators 36. The sensors 66 also may comprise motion measurement sensors arranged between and/or in line with the cutters 62 and actuators 36. In some applications, sensors 66 comprise drilling dynamics sensors which also may be arranged between and/or in line with the cutters 62 and actuators 36. The sensors 66 also may comprise seismic sensors arranged in various patterns on monolithic structure 30, including being arranged between and/or in line with the cutters 62 and actuators 36.

As further illustrated in FIG. 2, steering control system 56 may be coupled with actuators 36 and sensors 66 by communication lines 68 and 70, respectively. The actuator communication lines 68 can be used to provide control signals between steering control system 56 and actuators 36. For example, if steering actuators 36 are electronically actuated, e.g. solenoid based actuators, electrical power is provided to the actuators 36 through communication lines 68. If, on the other hand, the actuators 36 are actuated by fluid, e.g. hydraulic fluid, then communication lines 68 are designed to conduct fluid between steering control system 56 and actuators 36. Similarly, the sensor communication lines 70 may be designed to deliver signals to and/or from the various sensors 66 and may comprise electrical lines, optical fibers, hydraulic lines, or other suitable communication lines for carrying the desired data signals. In the specific embodiment illustrated, monolithic structure 30 allows the communication lines, e.g. data signal lines and power lines, to be constructed within the monolithic structure 30 without requiring any communication line connections along the monolithic structure other than possible connections with steering control system 56.

In some applications, data signals and/or power signals are communicated between steerable drilling assembly 28 and systems above the steerable drilling assembly. For example, signals may be communicated with surface control 54 and/or various systems located in the drill collars 38. The signals are communicated uphole and/or downhole as desired to facilitate control over steerable drilling assembly 28 and/or to provide data and information to systems uphole. In some embodiments, the signals may be sent uphole and/or downhole via wired drill pipe. In the example illustrated, steerable drilling assembly 28 comprises a communication feature 72 designed to allow transfer of signals and thus enable communication between steering control system 56 and the systems located uphole, such as surface control 54 and/or systems within drill collars 38, e.g. logging-while-drilling or measurement-while drilling modules 40. If wired drill pipe is used to transfer signals along drill string 24, the communication feature 72 may be in the form of a wired drill pipe connector coil embedded in the end of monolithic structure 30.

Depending on the types of communication lines and the method of communication, the communication feature 72 may comprise one or more types of communication line connectors 74, such as conductive connectors, electromagnetic connectors, magnetic connectors, optical connectors, sonic connectors, or other types of connectors and supporting modules to facilitate communication between the steerable drilling assembly 28 and systems located uphole. By way of example, information exchanged between steering control system 56 and systems located uphole, e.g. surface control 54 and drill collars 38, includes inclination and azimuth as well as desired inclination and azimuth. In one relatively simple embodiment, data and power may be used to actuate the steering actuators 36 directly according to a desired control pattern.

By combining the steering body section 32 and bit body section 34 into the single monolithic structure 30, only one field breakable connection 76 is located on the monolithic structure 30. As illustrated, the field breakable connection 76 is located on an uphole end 78 of the monolithic structure 30. In one embodiment, the field breakable connection 76 is a standard API connection having a pin-up or a pin-down configuration. The field breakable connection 76 allows the unitary, monolithic structure 30 of the steerable drilling assembly 28 to be connected into drill string 24 by engagement with, for example, an adjacent drill collar 38.

In many applications, toolface information and electrical power is delivered downhole to steerable drilling assembly 28 via communication feature 72 and steering control system 56. In some embodiments, however, toolface information and electrical power may be carried within the monolithic structure 30. For example, the steering control system 56 may include, or work in cooperation with, a local battery or power source 80 which provides power to operate steering actuators 36 and/or other components of the steerable drilling assembly 28. Similarly, the toolface information may be stored locally instead of being delivered downhole through communication feature 72. In this latter embodiment, a memory module 82, such as a solid-state memory module, may be included in steering control system 56 or otherwise positioned within monolithic structure 30 to provide drilling instructions and other toolface information to the steering control system 56 and steerable drilling assembly 28. This allows the steering control system 56 to optionally be constructed as a closed loop control for closing the control loop between directional measurements received from sensors 66 and steering actuation output via the steering actuators 36.

Figure 3:
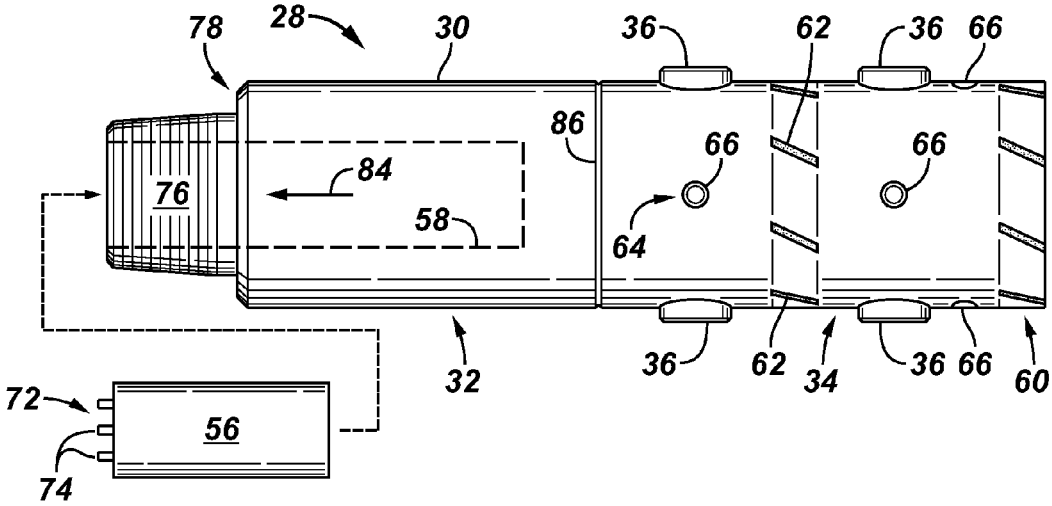
FIG. 3 is a schematic illustration of another example of a steerable drilling assembly having a bit body section and a steering body section formed as a monolithic structure, according to an embodiment of the present invention.

Referring generally to FIG. 3, another embodiment of steerable drilling assembly 28 is illustrated. In this example, steering control system 56 is a modular system which is removable from cavity 58, as illustrated by arrow 84. The modular design enables the electronics and other components of steering control system 56 to be interchanged between steerable drilling assemblies 28 by, for example, simply inserting the modular unit into a corresponding cavity of a monolithic structure in another steerable drilling assembly. In some examples, the sensor system 64 also is interchanged with other drilling assemblies. It should be noted that the monolithic structure 30 illustrated in FIG. 3 is formed with two assemblies which have been permanently affixed along a connection region 86. The permanent connection region 86 may be formed by, for example, welding, press fitting, threaded engagement, swaging, bolting or other techniques able to form the monolithic structure 30 which is not field breakable beneath the single field breakable connection 76. Additionally, the communication feature 72 and connectors 74 may be part of the steering control system 56 instead of being separately mounted on the monolithic structure 30.

The monolithic structure 30 and the relatively shorter length of the overall steerable drilling assembly resulting from the monolithic structure enables improved control over the drilling of wellbore 26 in many applications. For example, the distance between cutter structure 60 and steering actuators 36 can be reduced or changed to provide a variety of configurations which enhance the ability to turn in a tighter radius or to turn according to other desired patterns. This can enhance the capability for creating desired doglegs and other wellbore features. The monolithic structure also facilitates use of steering actuators 36 to provide other types of control over the steerable drilling assembly 28. For example, the steering actuators 36 may be controlled to perform drilling mechanics dampening.

Figure 4:
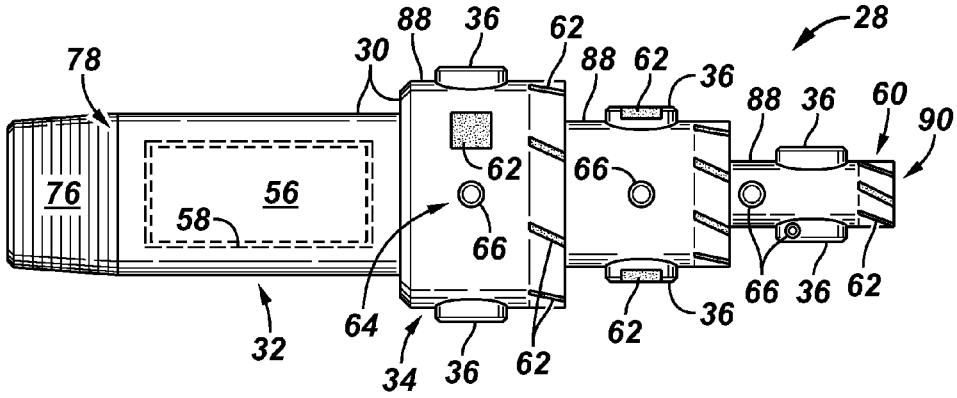
FIG. 4 is a schematic illustration of another example of a steerable drilling assembly having a bit body section and a steering body section formed as a monolithic structure, according to an embodiment of the present invention.

The monolithic structure further enables a much wider range of designs for creating steering assemblies and allows movement away from traditional drill bit configurations. Another such embodiment of steerable drilling assembly 28 is illustrated in FIG. 4. In this embodiment, the bit body section 34 of the monolithic structure 30 is formed as a multitiered bit body having a plurality of tiers 88 of different diameters. For example, the lead end tier 88 may have the smallest diameter with each sequential tier 88 having a progressively larger diameter. In the specific example illustrated, bit body section 34 has three tiers 88 with each tier having a progressively larger diameter moving away from a lead end 90 of the monolithic structure 30. However, the multiple tiers 88 and the steering body section 32 are all formed as a unitary, monolithic structure with no field separable connector other than the single connector 76 located at the uphole end 78 of monolithic structure 30.

In the embodiment illustrated in FIG. 4, the steering actuators 36, cutters 62 and sensors 66 may be arranged in a variety of patterns. For example, cutters 62 may be interspersed with the steering actuators 36. The cutters 62 also may be mounted on each tier 88 and positioned above, below, and/or in line with the steering actuators 36. In this particular embodiment, steering actuators 36 are mounted on each tier 88; however some embodiments may utilize tiers without actuators 36. Additionally, cutters 62 may be mounted on selected actuators 36, as illustrated with respect to the middle tier 88 in FIG. 4.

The sensors 66 of sensor system 64 also may be mounted between and/or in-line with cutters 62 and steering actuators 36 or at other desired locations along the monolithic structure 30. Sensors 66 also may be mounted on steering actuators 36 with or without cutters 62 mounted on the steering actuators 36. Depending on drilling operation requirements, sensors 66 may comprise formation measurement sensors, motion measurement sensors, drilling dynamics sensors, seismic sensors, caliper sensors, pressure sensors, temperature sensors, galvanic contacts, resistivity sensors, and/or other types of sensors arranged in various patterns with respect to cutters 62 and actuators 36.

The monolithic structure 30 provides a unitary bit body section and steering body section into which cutters 62 may be implanted or otherwise attached during construction of the steerable drilling assembly 28. The monolithic structure 30 enables many types of attachment mechanisms for attaching not only cutters 62 but also sensors 66 and steering actuators 36 along either or both of the bit body section 34 and steering body section 32 as desired for a given drilling operation. The monolithic structure 30 enables a wide variety of drilling assembly designs with many types of cutter, steering actuator, and sensor arrangements while enabling increased directional steerability.

Depending on the specific drilling application and environment, the well drilling system 20 and steerable drilling assembly 28 may be constructed according to a variety of configurations with many types of components. The actual construction and components of the drilling system depend on the type of lateral wellbore desired and the size and shape of the reservoir. For example, the shape of the monolithic structure 30 and the arrangement of steering actuators along the monolithic structure may be altered according to the type of rock formation through which the wellbore is drilled. The actuators 36 also may include alternate or additional components to perform other desired functions. For example, drilling applications which involve exiting from casing may incorporate steel cutting structures in or on actuators 36. The cutting structures are pushed outwardly for cutting the casing and then retracted upon entry of the drill bit into the rock formation.

Additionally, the steering control system may be an automated control system, such as a processor-based control coupled to a variety of sensors and steering actuators. In some applications, the control system may be designed as a closed loop control system operating on feedback from the sensors and/or steering actuators. In other applications, the control system may receive signals from and relay signals to other systems, such as the surface control or other downhole modules. In such applications, control instructions may be provided in whole or in part to the downhole steering control system located within the monolithic structure. The components of the control system also are selected to enable interaction with the specific types of sensors and/or actuators selected for use along the monolithic structure.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for drilling a deviated wellbore, comprising:

a monolithic structure having an uphole end, a bottomhole end, a bit body section, and a steering body section, wherein the monolithic structure does not have a field breakable connection below the uphole end, wherein the bit body section comprises:

a lead end tier adjacent the bottomend of the monolithic structure; and a second tier between the lead end tier and the uphole end of the monolithic structure having a diameter greater than a diameter of the lead end tier;

a field breakable connection located on the uphole end of the monolithic structure, the field breakable connection is an American Petroleum Institute (API) connection having a pin-up or a pin-down configuration;

a plurality of cutters mounted on the bit body section;

a plurality of steering actuators mounted on the bit body section; and a control system mounted within the steering body section to control the plurality of steering actuators and thus the direction of drilling while forming the deviated wellbore.

2. The system as recited in claim 1, wherein the bit body section and the steering body section are formed of a single metal structure.

3. The system as recited in claim 1, wherein the bit body section and the steering body section comprise metal structures permanently affixed together.

4. The system as recited in claim 1, wherein the bit body section and the steering body section are at least two metal structures welded together.

5. The system as recited in claim 1, further comprising a plurality of sensors mounted on the monolithic structure and coupled to the control system to relay sensor data to the control system.

6. The system as recited in claim 5, wherein the plurality of sensors comprises sensors positioned in line with cutters and steering actuators.

7. The system as recited in claim 5, wherein the plurality of sensors includes at least one sensor mounted on at least one of the steering actuators.

8. The system as recited in claim 1, wherein the control system is modular and removable.

9. The system as recited in claim 1, wherein cutters of the plurality of cutters are interspersed with steering actuators of the plurality of steering actuators.

10. The system as recited in claim 1, wherein the steering actuators are dispersed along the length of the bit body section, and cutters are placed between the steering actuators.

11. The system as recited in claim 1 wherein at least some cutters of the plurality of cutters are placed on at least some of the steering actuators of the plurality of steering actuators.

12. The system as recited in claim 1, wherein the control system is coupled with a communication feature for relaying signals from and to components external to the monolithic structure.

13. A system for drilling a deviated wellbore, comprising: p1 a rotary steerable drilling assembly formed with a monolithic structure having an uphole end, a bottomhole end, a bit body section, and a steering body section, wherein the monolithic structure is a single metal structure and does not have a field breakable connection below the uphole end;

the bit body section comprising:

a lead end tier adjacent the bottomend of the monolithic structure; and a second tier between the lead end tier and the uphole end of the monolithic structure having a diameter greater than a diameter of the lead end tier;

the steering body section having a cavity sized to receive a control system; and a field breakable connection located on the uphole end of the of the monolithic structure, the field breakable connection having an American Petroleum Institute (API) pin-up or pin-down configuration.

14. The system as recited in claim 13, further comprising a plurality of cutters interspersed with a plurality of steering actuators mounted to the monolithic structure.

15. The system as recited in claim 14, further comprising a plurality of sensors mounted on the monolithic structure and a control system mounted in the cavity, the control system being coupled to the plurality of sensors and the plurality of steering actuator.

* * * * *